US010807825B2

(12) United States Patent
Hoshino et al.

(10) Patent No.: US 10,807,825 B2
(45) Date of Patent: Oct. 20, 2020

(54) SHEET PROCESSING APPARATUS, AND IMAGE FORMING APPARATUS AND SYSTEM INCORPORATING THE SAME

(71) Applicants: Tomomichi Hoshino, Kanagawa (JP); Shinji Asami, Tokyo (JP); Tomohiro Furuhashi, Kanagawa (JP); Michitaka Suzuki, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(72) Inventors: Tomomichi Hoshino, Kanagawa (JP); Shinji Asami, Tokyo (JP); Tomohiro Furuhashi, Kanagawa (JP); Michitaka Suzuki, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 24 days.

(21) Appl. No.: 16/255,891

(22) Filed: Jan. 24, 2019

(65) Prior Publication Data

US 2019/0284006 A1 Sep. 19, 2019

(30) Foreign Application Priority Data

Mar. 19, 2018 (JP) ..... 2018-050350

(51) Int. Cl.

| | |
|---|---|
| ***B65H 35/04*** | (2006.01) |
| ***B65H 35/00*** | (2006.01) |
| ***B65H 29/20*** | (2006.01) |

(52) U.S. Cl.
CPC ..... *B65H 35/008* (2013.01); *B65H 29/20* (2013.01)

(58) Field of Classification Search
CPC ..... B41F 13/60; B65H 35/04; B65H 35/08; B65H 35/008; B65H 45/30; B65H 2301/51212; B65H 2301/515323
See application file for complete search history.

(56) References Cited

U.S. PATENT DOCUMENTS 5,709,376 A * 1/1998 Ushirogata ..... B42C 1/12 270/58.11
7,740,238 B2 * 6/2010 Iijima ..... B42B 4/00 270/32

(Continued)

FOREIGN PATENT DOCUMENTS

CN 204172111 U 2/2015
DE 202016103433 U1 7/2016

(Continued)

OTHER PUBLICATIONS

Chinese Office Action dated Apr. 28, 2020.

*Primary Examiner* — Leslie A Nicholson, III
(74) *Attorney, Agent, or Firm* — Harness, Dickey & Pierce, P.L.C.

(57) ABSTRACT

A sheet processing apparatus includes a blade having a plurality of teeth aligned in a row, a mover to move in a direction in which the plurality of teeth is aligned and form a perforation in a sheet sandwiched by the blade and the mover, and a pressure device to press the mover toward the blade.

19 Claims, 14 Drawing Sheets

(56) References Cited

U.S. PATENT DOCUMENTS

| | | | | |
|---|---|---|---|---|
| 7,770,876 | B2 * | 8/2010 | Sasahara | B31F 1/08 270/20.1 |
| 8,091,877 | B2 * | 1/2012 | Iguchi | B65H 37/04 270/32 |
| 8,317,179 | B2 * | 11/2012 | Takata | B42B 4/00 270/30.08 |
| 8,413,974 | B2 * | 4/2013 | Shibasaki | B65H 45/30 270/32 |
| 8,424,859 | B2 * | 4/2013 | Ishikawa | B31F 1/08 270/32 |
| 2005/0000336 | A1 | 1/2005 | Hattori et al. | |
| 2007/0051219 | A1 | 3/2007 | Tamura et al. | |
| 2007/0107577 | A1 | 5/2007 | Hattori et al. | |
| 2011/0018188 | A1 * | 1/2011 | Sasahara | B31F 1/08 270/37 |
| 2011/0241274 | A1 * | 10/2011 | Iijima | B65H 45/18 270/37 |
| 2018/0207953 | A1 | 7/2018 | Schutz | |

FOREIGN PATENT DOCUMENTS

| | | | |
|---|---|---|---|
| JP | 11-226899 | | 8/1999 |
| JP | 11-291191 | | 10/1999 |
| JP | 2003-200494 | A | 7/2003 |
| JP | 2009-018357 | A | 1/2009 |
| JP | 2017-062993 | A | 3/2017 |
| JP | 6161120 | B2 | 7/2017 |
| KR | 10-2012-0111266 | A | 10/2012 |

* cited by examiner

SHEET PROCESSING APPARATUS, AND IMAGE FORMING APPARATUS AND SYSTEM INCORPORATING THE SAME

CROSS-REFERENCE TO RELATED APPLICATION

This patent application is based on and claims priority pursuant to 35 U.S.C. § 119 to Japanese Patent Application No. 2018-050350, filed on Mar. 19, 2018 in the Japanese Patent Office, the entire disclosure of which is hereby incorporated by reference herein.

BACKGROUND

Technical Field

This disclosure relates to a sheet processing apparatus, and an image forming apparatus and system incorporating the sheet processing apparatus.

Description of the Related Art

Conventionally, there is known a sheet processing apparatus including a blade having a plurality of teeth aligned in a row and a moving member that sandwiches a sheet together with the blade, moves in a direction in which the plurality of teeth is aligned, and forms a perforation at a position of the sheet sandwiched between the blade and the moving member.

SUMMARY

This specification describes an improved sheet processing apparatus that includes a blade having a plurality of teeth aligned in a row, a mover to move in a direction in which the plurality of teeth is aligned and form a perforation in a sheet sandwiched by the blade and the mover, and a pressure device to press the mover toward the blade.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
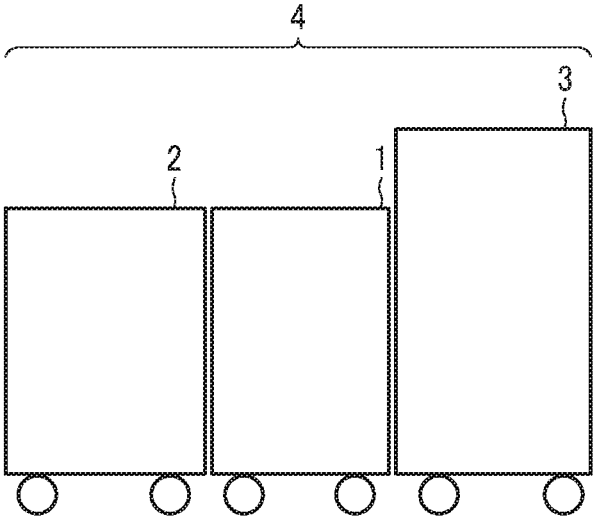
FIG. 1 is a schematic diagram illustrating a system configuration of an image forming system including an image forming apparatus and a plurality of sheet processing apparatuses according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

FIG. 1 is a schematic diagram illustrating a system configuration of an image forming system 4 according to an embodiment of the present disclosure, including an image forming apparatus and a plurality of sheet processing apparatuses. The image forming system 4 in the present embodiment includes a stitch perforation forming apparatus 1 and a post-processing apparatus 2, each of which serves as the sheet processing apparatus, provided in this order downstream from the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two functions of these machines. The image forming apparatus 3 may use any known image forming method, such as electrophotography or droplet ejection. The image forming apparatus 3 in the present embodiment is a copier using electrophotographic method.

Examples of the post-processing apparatus 2 include a punch apparatus that punches a hole in the sheet, a sheet binding apparatus in which a stapler or the like binds sheets and make a sheet bundle, and a sorter that sorts and ejects a sheet on which an image formed into each of a plurality of ejection trays.

Figure 2:
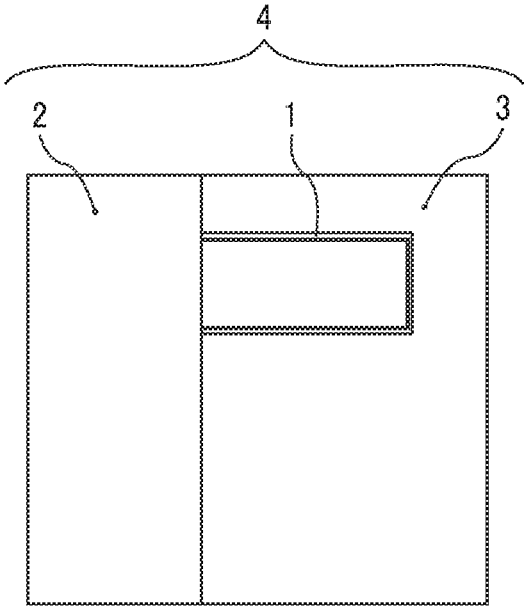
FIG. 2 is a schematic diagram illustrating another system configuration of the image forming system.

FIG. 2 is a schematic diagram illustrating another system configuration of the image forming system 4.

The image forming system 4 illustrated in FIG. 2 is configured by the post-processing apparatus 2 and the image forming apparatus 3 with a body covering a stitch perforation forming apparatus 1. The stitch perforation forming apparatus 1 may be provided in the post-processing apparatus 2.

Figure 3:
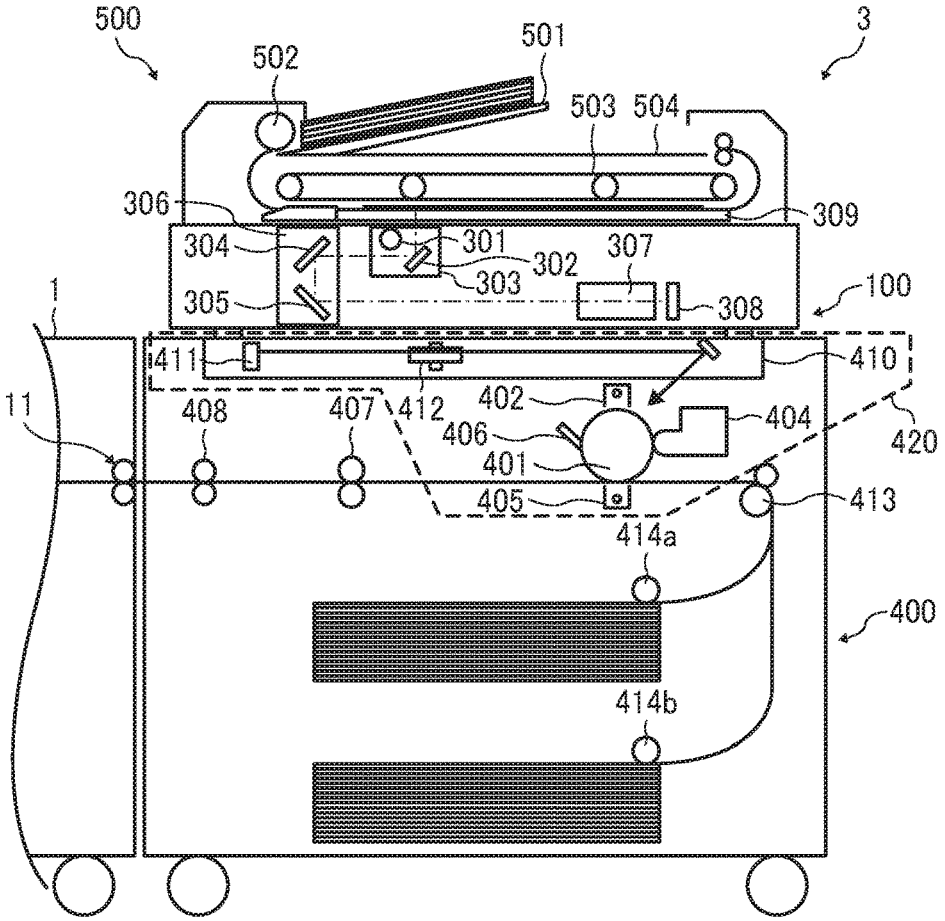
FIG. 3 is a schematic diagram illustrating an image forming apparatus.

FIG. 3 is a schematic diagram illustrating the image forming apparatus 3.

In the image forming apparatus main body 400, feeding cassettes to store sheets of recording media are disposed below an image forming device 420. After a sheet stored in each feeding cassette is fed by the feeding roller 414*a* or 414*b*, the sheet is conveyed upward along a predetermined conveyance path. Then the sheet reaches a registration roller pair 413.

The image forming device 420 includes a photoconductor drum 401 as an image bearer, a charger 402, an exposure device 410, a developing device 404, a transfer device 405, and a cleaner 406.

The charger 402 uniformly charges a surface of the photoconductor drum 401. The exposure device 410 forms an electrostatic latent image on the photoconductor drum 401 based on image data read by a scanner 100. The developing device 404 adheres toner to the electrostatic latent image formed on the photoconductor drum 401 to form a visible image as a toner image. The transfer device 405 transfers the toner image from the photoconductor drum 401 onto the sheet. The cleaner 406 removes toner remaining on the photoconductor drum 401 after the transfer.

On the downstream side of the image forming device 420 in the sheet conveyance direction, a fixing device 407 to fix the toner image on the sheet is disposed.

The exposure device 410 includes a laser unit 411 to emit a laser beam based on the image data under a control of a controller and a polygon mirror 412 to scan the laser beam from the laser unit 411 in a rotation axis direction of the photoconductor drum 401 which is called a main scanning direction.

An automatic document feeder 500 is mounted on the scanner 100. The automatic document feeder 500 includes a platen 501, a separation and feed roller 502, an original conveyor belt 503, and an original ejection tray 504.

When the automatic document feeder 500 receives an instruction to start scanning originals placed on the platen 501, the separation and feed roller 502 feeds the originals one by one from the platen 501 to the original conveyor belt 503. The original conveyor belt 503 moves the originals onto a platen glass 309 where each of the originals temporally stops.

Then, the scanner 100 reads the image data of the original temporarily stopped on the platen glass 309. Thereafter, the original conveyor belt 503 resumes conveyance of the original to eject the original onto the original ejection tray 504.

A more detailed description is now provided of an image reading operation and an image forming operation.

In addition to the platen glass 309, the scanner 100 includes a first carrier 303, a light source 301 and a mirror 302 provided on the first carrier 303, a second carrier 306, mirrors 304 and 305 provided on the second carrier 306, a lens 307, and a charge coupled device (CCD) 308. The light source 301 is lighted when the automatic document feeder 500 conveys the original onto the platen glass 309 or when a user places an original on the platen glass 309 and directs the image forming apparatus to start copying via an operation panel. In the meantime, the first carrier 303 and the second carriers 306 move along a guide rail.

The light source 301 emits light to the original positioned on the platen glass 309. Reflected light from the original is guided to the CCD 308 via the mirror 302, the mirrors 304 and 305, and the lens 307. The CCD 308 receives the reflected light and reads the image data of the original. The image data is converted from analog to digital data by an analog-to-digital (A/D) converter. The digital data is sent from a data output unit to the controller in the image forming apparatus main body 400.

On the other hand, the image forming apparatus main body 400 starts to drive the photoconductor drum 401, and after a rotation speed of the photoconductor drum 401 reaches a predetermined speed, the charger 402 uniformly charges the surface of the photoconductor drum 401. The exposure device 410 forms the electrostatic latent image on the charged surface of the photoconductor drum 401 based on the image data read by the scanner 100.

Thereafter, the developing device 404 develops the electrostatic latent image on the surface of the photoconductor drum 401 into a toner image. In the meantime, the feeding roller 414*a* or 414*b* feeds the sheet stored in the feeding cassette, and the registration roller pair 413 temporarily stops the sheet.

The registration roller pair 413 feeds the sheet to a transfer portion opposed to the transfer device 405 when a leading edge of the toner image formed on the surface of the photoconductor drum 401 reaches the transfer portion. While the sheet passes through the transfer portion, a transfer electric field transfers the toner image formed on the surface of the photoconductor drum 401 onto the sheet.

The sheet on which the toner image is transferred is conveyed to the fixing device 407, subjected to a fixing process by the fixing device 407, and then ejected to the stitch perforation forming apparatus 1 at the subsequent stage. The cleaner 406 removes residual toner which is not transferred onto the sheet at the transfer portion and remains on the surface of the photoconductor drum 401.

Figure 4:
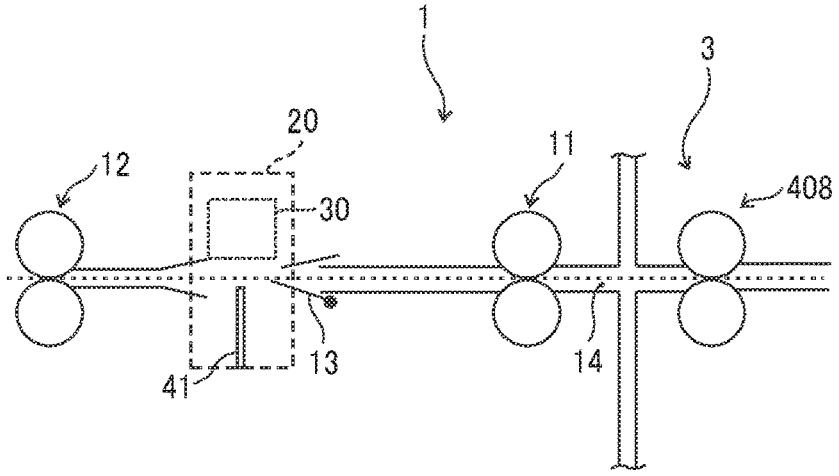
FIG. 4 is an explanatory diagram illustrating a stitch perforation forming apparatus.

FIG. 4 is an explanatory diagram illustrating the stitch perforation forming apparatus 1.

As illustrated in FIG. 4, the stitch perforation forming apparatus 1 includes an entry roller pair 11, a pivoting guide plate 13, a perforator 20, and an ejection roller pair 12 from the entrance side along a conveyance path 14.

The entry roller pair 11 is positioned at the entrance of the stitch perforation forming apparatus 1 to receive sheets ejected by ejection rollers 408 of the image forming apparatus 3 and forward the sheets to the perforator 20.

The pivoting guide plate 13 is disposed downstream from the entry roller pair 11 in the direction in which the sheet is transported. The pivoting guide plate 13 can pivot around a downstream end portion in the sheet conveyance direction as a fulcrum. When the sheet is conveyed, the pivoting guide plate 13 is positioned at a guide position as illustrated in FIG. 4, and when the perforator 20 forms stitch perforations in the sheet, the pivoting guide plate 13 pivots counterclockwise in FIG. 4 and is positioned at a retracted position.

The ejection roller pair 12 is disposed just upstream of the outlet of the last stage of the stitch perforation forming apparatus 1 and ejects the sheet.

Figure 5A:
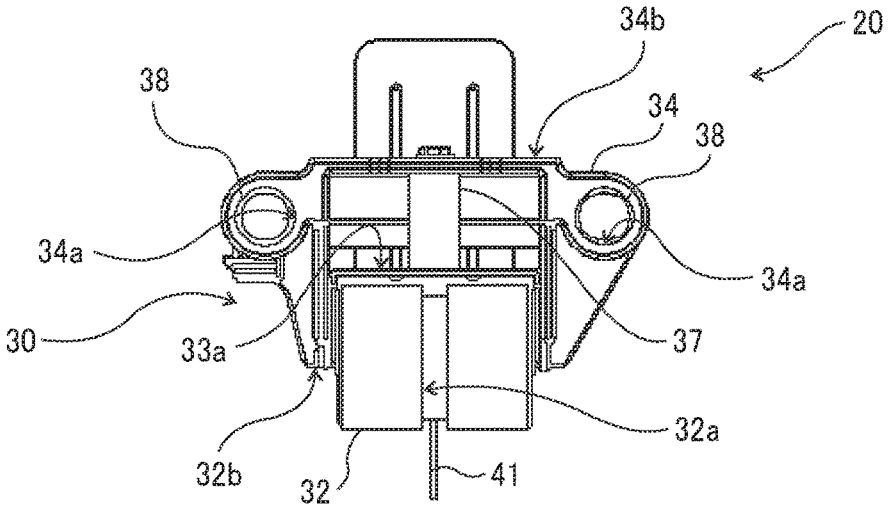
FIGS. 5A and 5B are schematic diagrams illustrating a perforator.
Figure 5B:
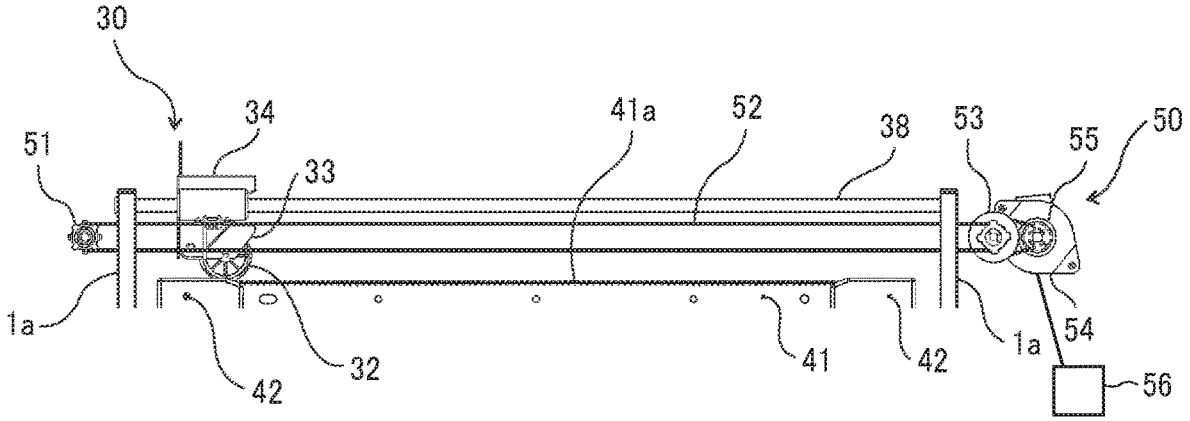
Figure 6:
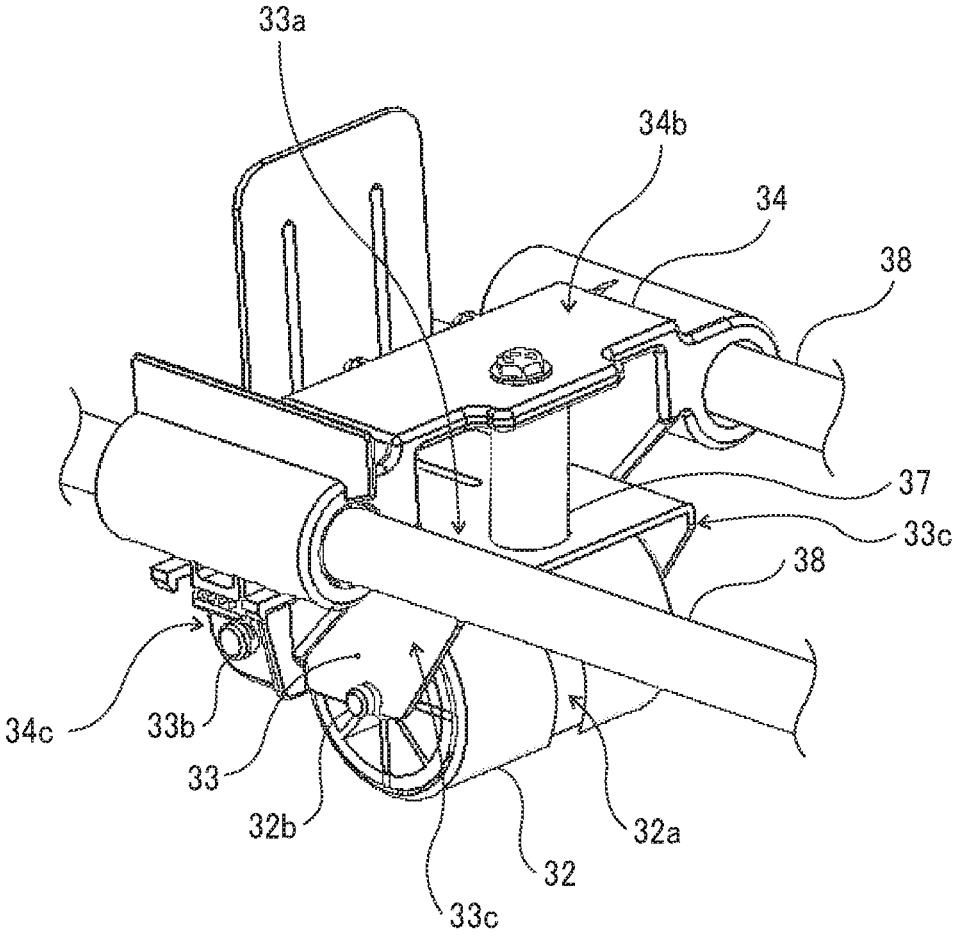
FIG. 6 is a perspective view illustrating a pressing mechanism.

FIGS. 5A and 5B are schematic diagrams illustrating the perforator 20. FIG. 5A is a view of the perforator 20 as seen from the sheet width direction and FIG. 5B is a view of the perforator 20 as seen from the upstream side of the sheet conveyance direction. Additionally, FIG. 6 is a perspective view of the pressing mechanism 30.

As illustrated in FIGS. 5A and 5B, the perforator 20 includes a blade 41 on which a plurality of teeth 41*a* is formed and a pressing mechanism 30 that presses the sheet against the blade 41. Side plates 1*a* of the stitch perforation forming apparatus 1 support both ends of the pressing mechanism 30, and a pair of guide rails 38 arranged side by side in the sheet conveyance direction supports the pressing mechanism 30 movable in a sheet width direction that is a left and right direction in FIG. 5B.

Additionally, the perforator 20 includes a driver 50 to move the pressing mechanism 30 in the sheet width direction that is a left and right direction in FIG. 5B and a controller 56 to control the driver 50. The driver 50 includes a drive motor 54, a drive pulley 53 to which the driving force of the drive motor 54 is transmitted via the timing belt 55, a driven pulley 51 arranged on the side opposite the side on which the drive pulley 53 is disposed, and a movement timing belt 52 stretched around the drive pulley 53 and the driven pulley 51. The pressing mechanism 30 is attached to the movement timing belt 52. The controller 56 controls the drive motor 54 based on the data transmitted from the image forming apparatus 3.

Forward and reverse rotation of the drive motor 54 moves the movement timing belt 52 to reciprocate the pressing mechanism 30 in the sheet width direction.

As illustrated in FIGS. 5A, 5B, and 6, the pressing mechanism 30 includes a roller 32 serving as a moving member, a holder 33 serving as a support member that supports the roller 32 so that the roller 32 can pivot in a direction perpendicular to the sheet and rotate, a slider 34 slidably supported by the pair of guide rails 38 to rotatably support the holder 33, and a coil spring 37 serving as a pressing member.

A groove 32*a* is formed in the center of the roller 32 opposite the blade 41 in the rotation axis direction that is the sheet conveyance direction. The groove 32*a* is opposite the blade 41. A shaft 32*b* attached to a roller support portion 33*c* of the holder 33 rotatably supports the roller 32. Or, the roller support portion 33*c* of the holder 33 may rotatably support a boss protruding from the rotation center of the roller 32 in a rotation axis direction.

The holder 33 is rotatably supported by a support shaft 33*b* attached to the slider 34. Accordingly, the roller 32 is pivotably supported in the direction perpendicular to the sheet around the support shaft 33*b* as a fulcrum. Or, the slider 34 may rotatably support a boss provided in the holder 33. In addition, the holder 33 includes a spring receiving base 33*a* that receives one end of the coil spring 37.

The slider 34 has through-holes 34*a* at both ends in the sheet conveyance direction, and the guide rail 38 passes through these through-holes 34*a*. As a result, the slider 34 is supported by the guide rail 38 to be slidable in the sheet width direction. Additionally, to receive the other end of the coil spring 37, the slider 34 has a spring receiving base 34*b* which is opposite the spring receiving base 33*a* of the holder 33. The coil spring 37 is fixed to the slider 34 with screws and urges the holder 33 toward the blade 41. Thereby, the roller 32 supported by the holder 33 is urged toward the blade 41, and the sheet can be pressed against the blade 41.

As illustrated in FIG. 5B, a retraction base 42 on which the roller 32 of the pressing mechanism 30 rides to get out of a sheet conveyance area is disposed outside the sheet conveyance area and outside the both ends of the blade 41.

FIGS. 7A to 7D are explanatory diagrams illustrating sheet conveyance in the stitch perforation forming apparatus 1.

Figure 7A:
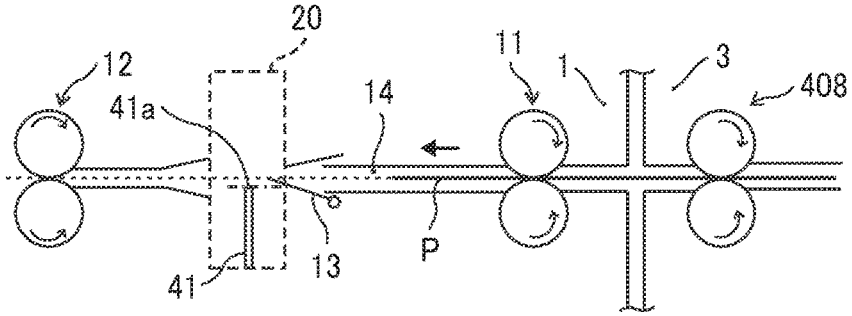
FIGS. 7A to 7D are explanatory diagrams illustrating sheet conveyance in the stitch perforation forming apparatus.

As illustrated in FIG. 7A, the ejection rollers 408 in the image forming apparatus 3 ejects the sheet P, and the entry roller pair 11 receives the sheet P and conveys the sheet P to the perforator 20. At this time, the pivoting guide plate 13 is at the guide position. The sheet P conveyed by the entry roller pair 11 is guided by the pivoting guide plate 13 and conveyed to the perforator 20.

As illustrated in FIG. 7A, the tip of the pivoting guide plate 13 at the guide position is positioned closer to the pressing mechanism 30 than the edges of the teeth 41*a* of the blade 41, that is, above the teeth 41*a* and the upper side in FIG. 7A. Therefore, the sheet P guided by the pivoting guide plate 13 passes over the teeth 41*a* and can be conveyed without being caught by the teeth 41*a* of the blade 41. This can prevent occurrence of sheet jam and skew of the sheet.

Figure 7B:
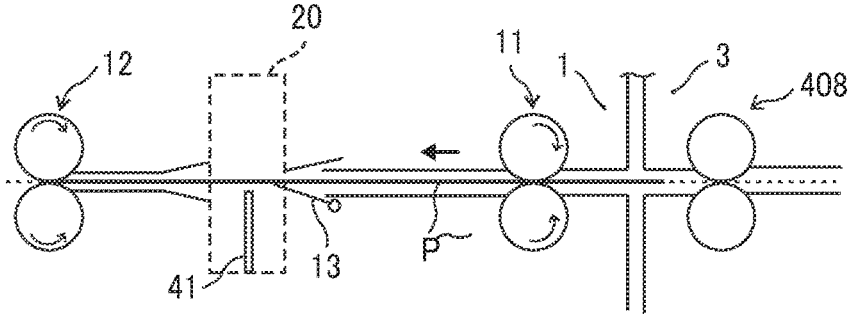

As illustrated in FIG. 7B, when the leading edge of the sheet P reaches the ejection roller pair 12, the sheet P is sandwiched and conveyed by the entry roller pair 11 and the ejection roller pair 12. When a stitch perforation position of the sheet P is opposite the blade 41, the entry roller pair 11 and the ejection roller pair 12 stop rotations.

Figure 7C:
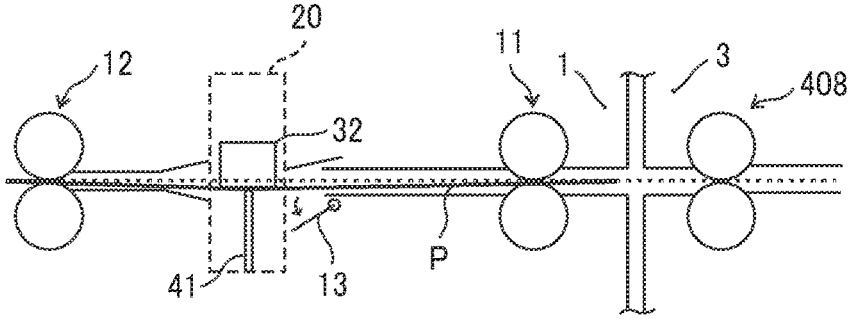

Next, the pivoting guide plate 13 pivots counterclockwise in FIG. 7C to position the pivoting guide plate 13 at the retracted position illustrated in FIG. 7C. When the pivoting guide plate 13 is positioned at the retracted position, the pressing mechanism 30 moves in the sheet width direction and presses the sheet P against the blade 41 to form the stitch perforations at predetermined positions in the sheet P.

After the perforator 20 forms the stitch perforations at the predetermined positions in the sheet P, the pivoting guide plate 13 pivots from the retracted position to the guide position. While the pivoting guide plate 13 pivots from the retracted position to the guide position, the pivoting guide plate 13 contacts the sheet P and lifts the sheet P. This separates the teeth 41*a* stuck in the sheet P from the sheet P. As described above, in the present embodiment, the pivoting guide plate 13 functions as a separator to separate the sheet P from the blade 41.

Figure 7D:
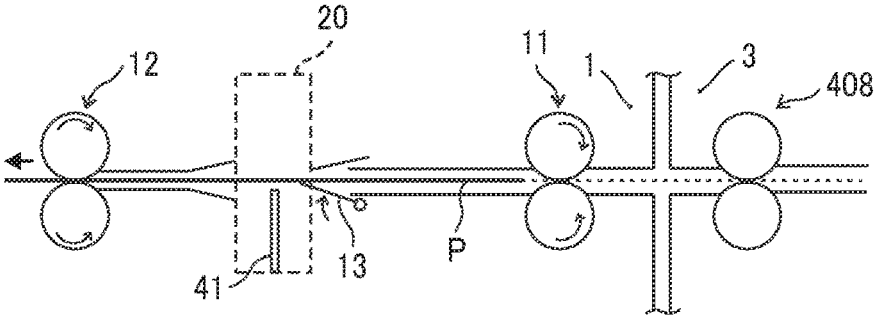

Next, as illustrated in FIG. 7D, after the pivoting guide plate 13 is positioned at the guide position, the entry roller pair 11 and the ejection roller pair 12 rotate to convey the sheet P again. Sheet conveyance after the pivoting guide plate 13 separates the teeth 41*a* stuck in the sheet P from the sheet P prevents breakage of the sheet P caused by the teeth 41*a* stuck in the sheet P and a jam caused by the sheet hooked by the teeth 41*a* stuck in the sheet P.

Next, the perforation forming operation of the perforator 20 is described.

FIGS. 8A to 8D are explanatory diagrams illustrating the perforation forming operation of the perforator 20.

Figure 8A:
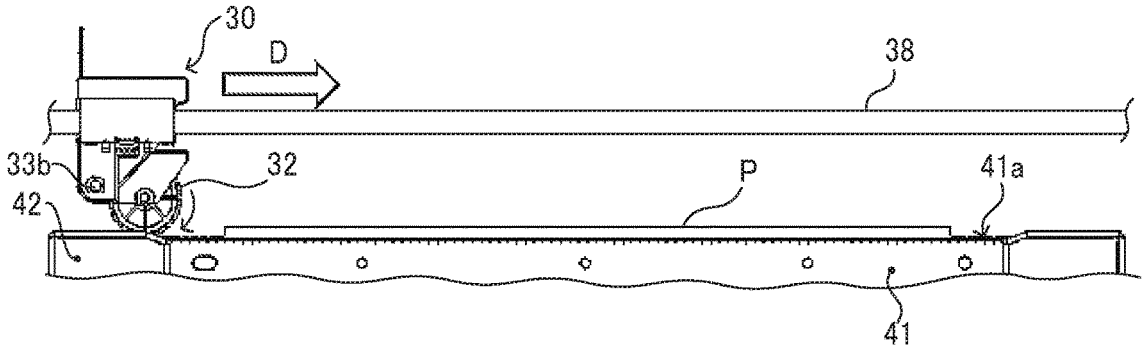
FIGS. 8A to 8D are explanatory diagrams illustrating a perforation forming operation of the perforator.

As illustrated in FIG. 8A, before the perforation forming operation, the pressing mechanism 30 is at a retracted position, and the roller 32 rides up onto the retraction base 42, After the sheet P stops at a predetermined position, the drive motor 54 starts moving the pressing mechanism 30 from one end to the other end in the sheet width direction, that is, the left end to the right end in FIGS. 8A to 8D. Then, the roller 32 moves in a direction of an arrow D in FIG. 8A while rolling over the cutting edge of the teeth 41*a*.

Figure 8B:
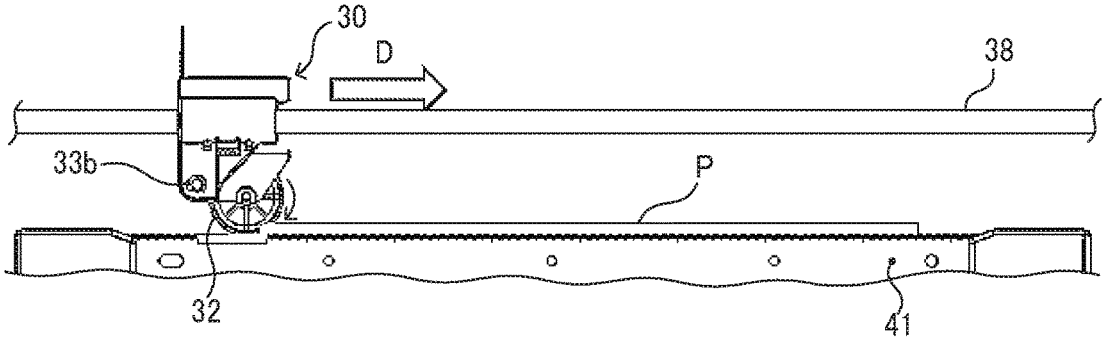

As illustrated in FIG. 8B, when the pressing mechanism 30 moves in the direction of the arrow D in FIG. 8B, the roller 32 contacts the sheet P, and the sheet P is sandwiched between the roller 32 and the blade 41. The coil spring 37 presses the roller 32 toward the blade 41 via the holder 33. Therefore, the roller 32 presses the sheet P against the blade 41, and the teeth 41*a* of the blade 41 pierce the sheet P to penetrate the sheet P, thereby forming the stitch perforation. In the present embodiment, as illustrated in FIG. 5A, the roller 32 has the groove 32*a* at the position opposed to the blade 41. As a result, when the roller 32 contacts the sheet P, a gap is formed between the groove 32*a* and the sheet P, thereby ensuring penetration of the sheet P by the teeth 41*a* and reliable stitch perforation.

In the present embodiment, the holder 33 supports the roller 32 so as to be able to pivot in the direction perpendicular to the sheet P. Therefore, the roller 32 can trace the irregularities of the edges of the teeth 41*a* of the blade 41, which makes it difficult for the roller 32 to catch on the teeth 41*a* of the blade 41. This enables smooth movement of the pressing mechanism 30 in the sheet width direction. In addition, this reduces variation of the pressing force due to manufacturing tolerances and ensures good sheet perforation.

In addition, the rotation on the sheet of the roller 32 serving as a moving member moving on the sheet makes it possible to reduce resistance of the movement and enables smooth movement of the pressing mechanism 30 in the sheet width direction.

Figure 8C:
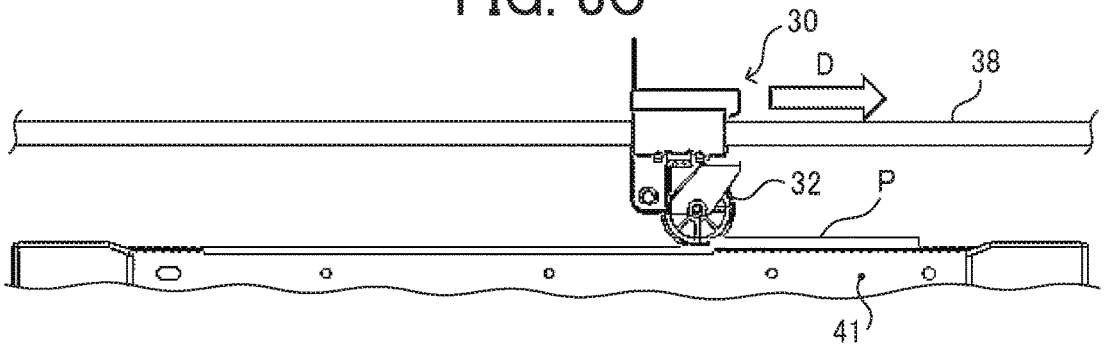
Figure 8D:
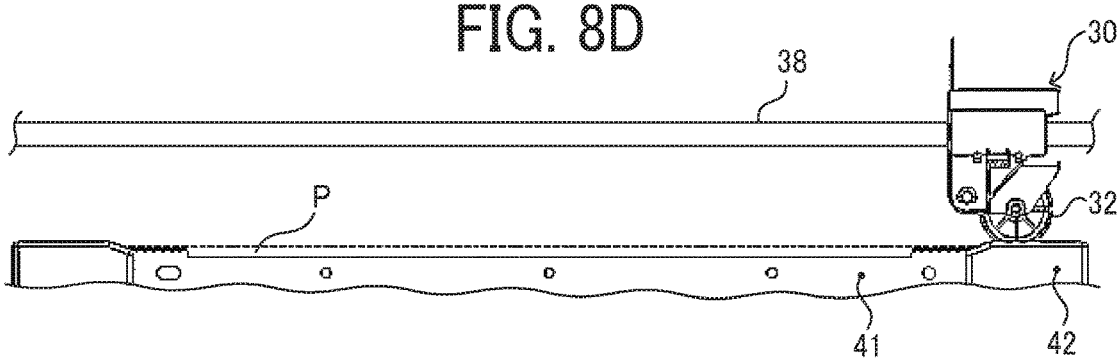

While the pressing mechanism 30 moves in the direction of the arrow D in FIGS. 8A to 8C, the stitch perforations are formed in the sheet P. Finally, as illustrated in FIG. 8D, the pressing mechanism 30 reaches the retracted position at the right end of FIG. 8D, rides up onto the retraction base 42, and the perforation forming operation is completed. When the stitch perforations are formed in the next sheet, the pressing mechanism 30 moves in a direction opposite the arrow D in FIGS. 8A to 8C to form the stitch perforations. Or, after the trailing end of the sheet P on which the stitch perforations are formed passes through a portion opposite the blade 41, the pressing mechanism 30 may move in the direction opposite the arrow D in FIGS. 8A to 8C and reach the retracted position on the left side in FIGS. 8A to 8C to limit a direction of movement of the pressing mechanism 30 when the stitch perforations are formed in the sheet P to the direction of the arrow D illustrated in FIGS. 8A to 8C.

The configuration in which the coil spring 37 presses the blade 41 separably contacting the pressing mechanism 30 toward the pressing mechanism 30 needs a plurality of coil springs arranged in the sheet width direction to obtain a predetermined pressing force at all positions in the sheet width direction because the blade 41 is long in the sheet width direction. In this case, manufacturing tolerances cause a difference in pressing force by the coil spring and prevents formation of uniform stitch perforations.

On the other hand, in the present embodiment, since the pressing mechanism 30 including the coil spring 37 and moving in the sheet width direction can press the sheet with the same force at each position in the sheet width direction, uniform stitch perforations can be formed.

Preferably, a pivoting fulcrum of the roller 32 that is a rotational axis of the holder 33 is separated from the blade 41 by an amount greater than the supporting position such as shaft 32*b* of the roller 32, that is, a distance between the blade 41 and the pivoting fulcrum of the roller 32 is equal to or larger than a distance between the blade 41 and the supporting position at which the holder 33 supports the roller 32.

Figure 9A:
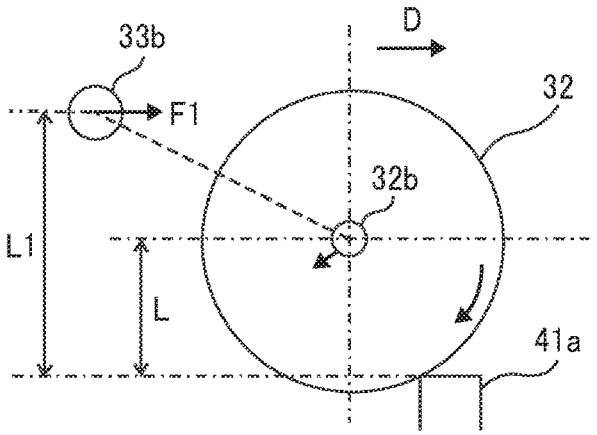
FIG. 9A is an explanatory diagram illustrating an example in which a pivoting fulcrum of a roller is away from the blade with respect to the support position of the roller.
Figure 9B:
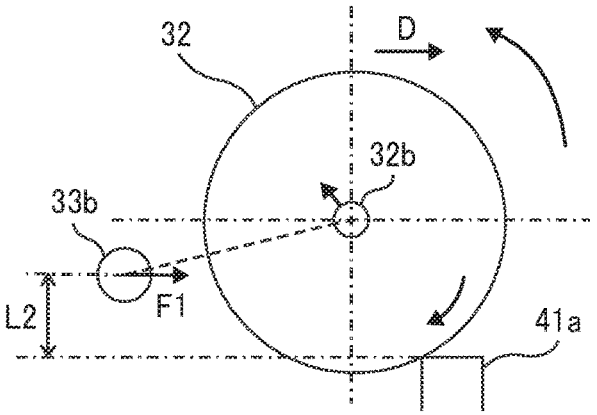
FIG. 9B is an explanatory diagram illustrating an example in which the pivoting fulcrum of the roller is provided on the blade side with respect to the support position of the roller.

FIG. 9A is an explanatory diagram illustrating an example in which the pivoting fulcrum of the roller 32 is away from the blade 41 with respect to the support position of the roller 32, that is, L1>L in FIG. 9A. FIG. 9B is an explanatory diagram illustrating an example in which the pivoting fulcrum of the roller 32 is provided on the blade side with respect to the support position of the roller 32, that is, L2<L in FIG. 9B.

As illustrated in FIGS. 9A and 9B, when the driver 50 moves the pressing mechanism 30 in the direction of the arrow D in FIGS. 9A and 9B, the driving force of the driver 50 is applied to the support shaft 33*b*, which is the pivoting fulcrum of the roller 32, via the slider 34 in a direction of an arrow F1. As illustrated in FIG. 9B, when the pivoting fulcrum of the roller 32 is on the blade side relative to the support position of the roller 32, a moment away from the blade acts on the roller 32 and may cause a jump of the roller 32 when the roller 32 rides up onto a tooth 41*a* of the blade 41. As a result, the pressing force decreases, which may obstruct formation of good stitch perforations.

On the other hand, as illustrated in FIG. 9A, when the pivoting fulcrum of the roller 32 is separated from the blade beyond the support position of the roller 32, a moment toward the blade 41 acts on the roller 32. As a result, the roller 32 does not jump up when the roller 32 rides up onto the tooth 41*a* of the blade 41, and the pressing force does not decrease. Therefore, good stitch perforations can be formed.

In addition, it is preferable that stitch perforations are formed in the direction of movement of the pressing mechanism 30 in which the pivoting fulcrum of the roller 32 that is the support shaft 33*b* is on the upstream side of the roller 32 in the direction of movement of the pressing mechanism 30.

Figure 10A:
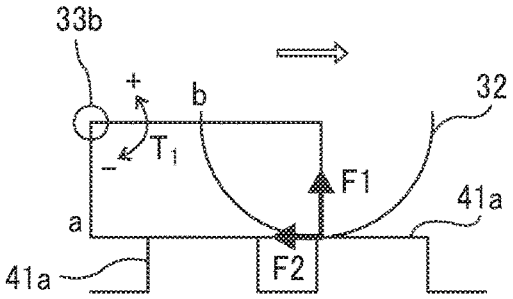
FIG. 10A is an explanatory diagram illustrating a dynamic model when the pivoting fulcrum of the roller is upstream from the roller in a direction of movement of the pressing mechanism.
Figure 10B:
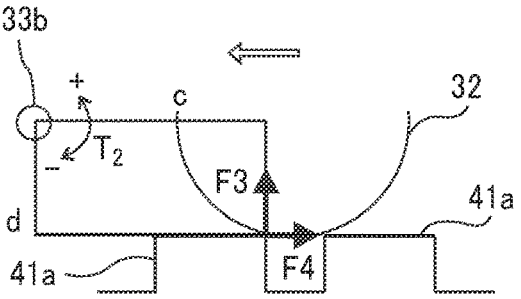
FIG. 10B is an explanatory diagram illustrating a dynamic model when the pivoting fulcrum of the roller is downstream from the roller in a direction of movement of the pressing mechanism.

FIG. 10A is an explanatory diagram illustrating a dynamic model when the pivoting fulcrum of the roller 32 is upstream from the roller 32 in the direction of movement of the pressing mechanism 30. FIG. 10B is an explanatory diagram illustrating a dynamic model when the pivoting fulcrum of the roller 32 is downstream from the roller 32 in the direction of movement of the pressing mechanism 30.

As illustrated in FIG. 10A, when a length in the direction of movement of the pressing mechanism 30 from the support shaft 33*b*, which is the pivoting fulcrum of the roller 32, to the contact position between the roller 32 and the tooth 41*a* is b, a length from the support shaft 33*b* to the contact position between the roller 32 and the tooth 41*a* in a direction orthogonal to the direction of movement is a, a force in the direction of movement when the tooth 41*a* contacts the roller 32 is F2, and a force in a direction orthogonal to the direction of movement when the tooth 41*a* contacts the roller 32 is F1, a moment $T_1$ around the support shaft 33*b* is expressed by a following equation 1.

$$T_1=F1\times b-F2\times a. \quad \text{(Equation 1)}$$

From the above equation, the force F1 in the direction orthogonal to the direction of movement, that is, a normal force that equals to the pressing force, is expressed by a following equation 2.

$$F1=(T_1+F2\times a)/b. \quad \text{(Equation 2)}$$

As illustrated in FIG. 10B, when a length in the direction of movement of the pressing mechanism 30 from the support shaft 33*b*, which is the pivoting fulcrum of the roller 32, to the contact position between the roller 32 and the tooth 41*a* is c, a length from the support shaft 33*b* to the contact position between the roller 32 and the tooth 41*a* in a direction orthogonal to the direction of movement is d, a force in the direction of movement when the tooth 41*a* contacts the roller 32 is F4, and a force in a direction orthogonal to the direction of movement when the tooth 41*a* contacts the roller 32 is F3, a moment $T_2$ around the support shaft 33*b* is expressed by a following equation 3.

$$T_2=F3\times c+F4\times d. \quad \text{(Equation 3)}$$

From the above equation, the force F3 in the direction orthogonal to the direction of movement, that is, a normal force that equals to the pressing force, is expressed by a following equation 4.

$$F3=(T_2-F4\times d)/c. \quad \text{(Expression 4)}$$

Here, $T_1$ and $T_2$ are spring pressures of the coil spring 37, $T_1=T_2$, and a=d. Although b>c, since the difference between b and c is small, b can be regarded as c, that is, b≈c. Since F2 and F3 are frictional forces between the tooth 41*a* and the roller 32, F2=F3. Therefore, F3 can be approximated by the following equation (5).

$$F3\approx(T_1-F2\times a)/b. \quad \text{(Equation 5)}$$

As can be seen from a comparison between Equation 2 and Equation 5, the normal force F1 (that equals to the pressing force) when the pivoting fulcrum of the roller 32 is upstream from the roller 32 in the direction of movement of the pressing mechanism 30 is greater than the normal force F3 (that equals to the pressing force) when the pivoting fulcrum of the roller 32 is downstream from the roller 32 in the direction of movement of the pressing mechanism 30. Therefore, the stitch perforations can be reliably formed by moving the pressing mechanism 30 so that the pivoting fulcrum of the roller 32 is upstream from the roller 32 in the direction of movement of the pressing mechanism 30.

In addition, it is preferable to change a movement of the pressing mechanism 30 depending on thickness of the sheet.

Figure 11:
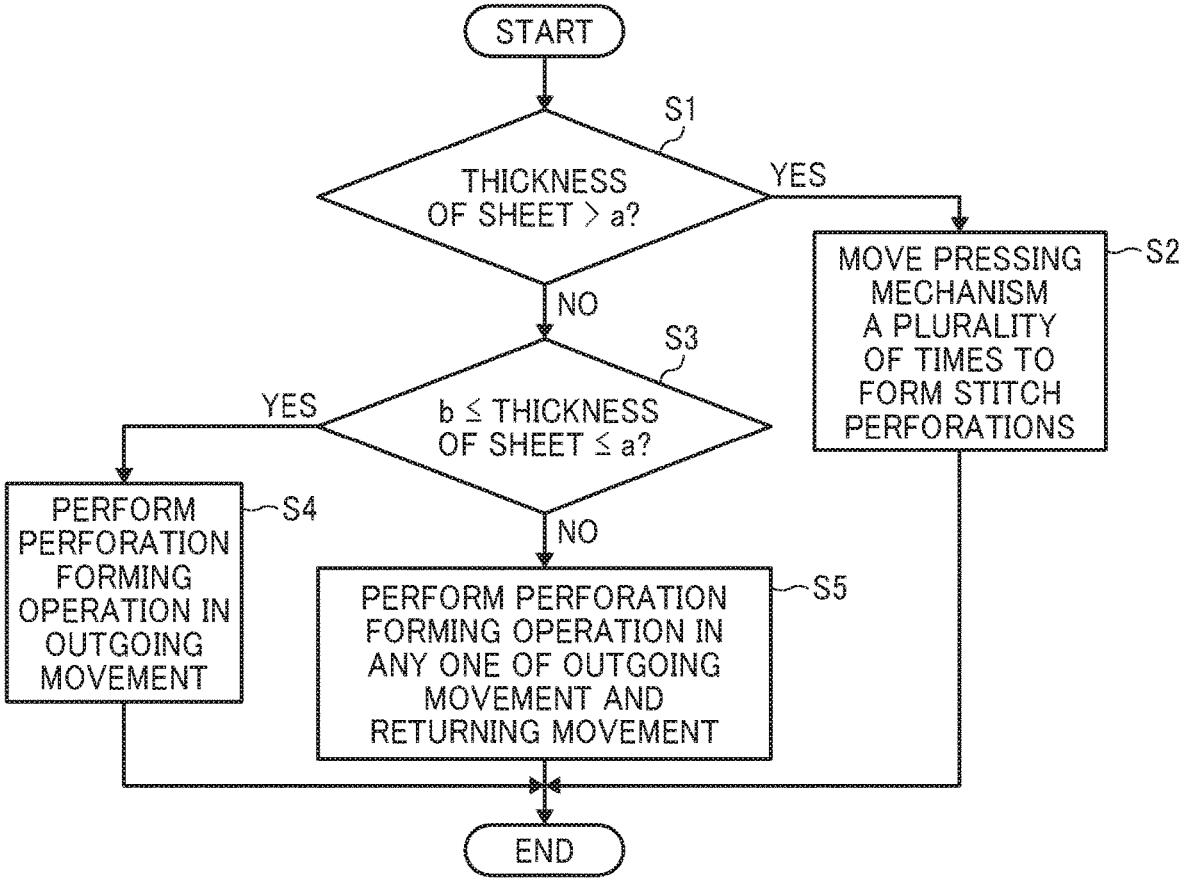
FIG. 11 is a flow chart of movement control of the pressing mechanism.

FIG. 11 is a flow chart of movement control of the pressing mechanism 30.

A controller 56 to control the drive motor 54 in the driver 50 acquires sheet thickness data as data of the sheet conveyed from the image forming apparatus 3. When the thickness of the sheet conveyed based on the acquired sheet thickness data is greater than a mm (YES in step S1), one movement of the pressing mechanism 30 is not enough to satisfactorily form the stitch perforations. Accordingly, when the thickness of the sheet exceeds a mm (YES in step S1), the controller moves the pressing mechanism 30 a plurality of times to form the stitch perforations. This operation can satisfactorily form the stitch perforations in a thick sheet.

On the other hand, when the thickness of the sheet is greater than or equal to b mm and smaller than or equal to a mm (b<a) (NO in step S1 and YES in step S3), the pressing force in a return movement, that is, the movement to the left in FIG. 8 in which the pivoting fulcrum of the roller 32 is downstream from the roller 32 in the direction of movement of the pressing mechanism 30 is not enough to form good stitch perforations. Therefore, when the thickness of the sheet is greater than or equal to b mm and smaller than or equal to a mm (b<a) (NO in step S1 and YES in step S3), the controller forms the stitch perforations in an outgoing movement, that is, the movement to the right in FIG. 8 in which the pivoting fulcrum of the roller 32 is upstream from the roller 32 in the direction of movement of the pressing mechanism 30 (step S4). This operation can improve productivity more than when the thickness of the sheet exceeds a mm.

When the sheets having thickness of not smaller than b mm and not greater than a mm continuously conveyed, the controller returns the pressing mechanism 30, that is, moves the pressing mechanism 30 to the left in FIG. 8 after the sheet leaves the perforator 20 and before the next sheet comes to the perforator 20 to prepare the perforation forming operation for the next sheet.

On the other hand, when the thickness of the sheet is smaller than b mm (b<a) (NO in step S1 and NO in step S3), the stitch perforations can be satisfactorily formed even with a weak pressing force. Therefore, the stitch perforations can be satisfactorily formed even in the return movement, that is, the movement to the left in FIG. 8 in which the pivoting fulcrum of the roller 32 is downstream from the roller 32 in the direction of movement of the pressing mechanism 30. Therefore, in this case, the controller forms the stitch perforations in any one of the outgoing movement and the return movement (step S5).

When the thickness of the sheet is smaller than b mm, unlike when the thickness of the sheet is not smaller than b mm and not greater than a mm, the controller does not need to return the pressing mechanism 30 before the next sheet comes the perforator 20 and can keep the pressing mechanism 30 on standby at the position on the right side of FIG. 8. This makes it possible to narrow a space between the sheets and improve the productivity.

The values of "a" and "b" described above may be appropriately determined depending on the configuration of the apparatus.

Preferably, the coil spring 37 is disposed immediately above the roller 32.

Figure 12A:
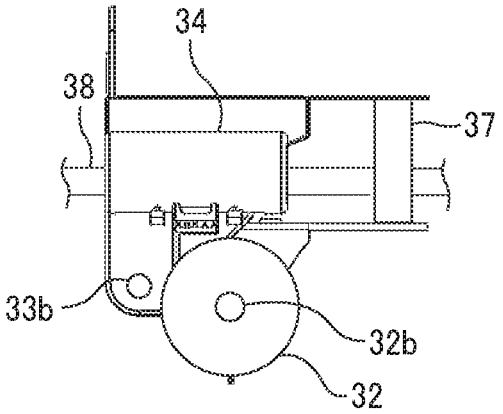
FIG. 12A is an explanatory diagram illustrating an example in which a coil spring is farther from the pivoting fulcrum of the roller than the roller.
Figure 12B:
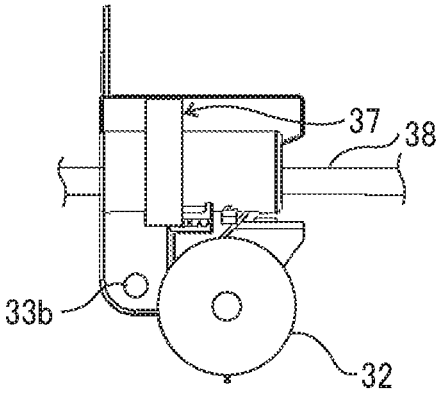
FIG. 12B is an explanatory diagram illustrating an example in which a coil spring is closer to the pivoting fulcrum of the roller than the roller.
Figure 12C:
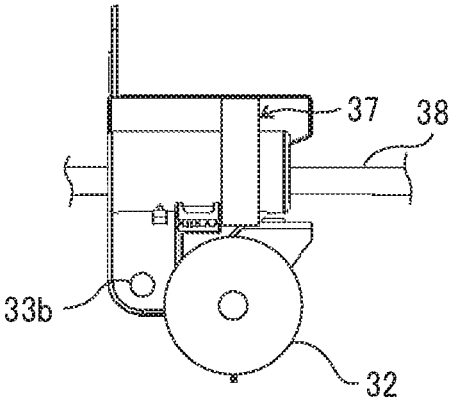
FIG. 12C is an explanatory diagram illustrating an example in which a coil spring is above the roller.

FIG. 12A is an explanatory diagram illustrating an example in which the coil swing 37 is farther from the pivoting fulcrum of the roller 32 that is the support shaft 33*b* than the roller 32. FIG. 12B is an explanatory diagram illustrating an example in which the coil spring 37 is closer to the pivoting fulcrum of the roller 32 that is the support shaft 33*b* than the roller 32. FIG. 12C is an explanatory diagram illustrating an example in which the coil spring 37 is disposed immediately above the roller.

As illustrated in FIG. 12A, since the coil spring 37 disposed farther from the pivoting fulcrum of the roller 32 that is the support shaft 33*b* than the roller 32 can push the holder at a pressing position further from the rotational axis of the holder that is the support shaft 33*b*, it is possible to obtain a desired pressing force even with a small swing pressure. However, setting the coil swing 37 father from the pivoting fulcrum of the roller 32 that is the support shaft 33*b* than the roller 32 has a disadvantage that the pressing force is susceptible to effect of spring pressure tolerance. In addition, since a pressing position on which the coil spring 37 presses the slider 34 is away from a support position on which the guide rail 38 support the slider 34, the slider 34 may bend.

As illustrated in FIG. 12B, setting the coil spring 37 disposed closer to the pivoting fulcrum of the roller 32 that is the support shaft 33*b* than the roller 32 has a disadvantage that a large spring pressure is needed to obtain the desired pressing force because the coil spring 37 pushes the holder at the pressing position near the rotational axis of the holder that is the support shaft 33*b*. In addition, increasing the spring pressure to obtain the desired pressing force leads to increasing a pressing force of the coil spring 37 that is applied to the slider 34, as a result, the slider 34 may bend.

On the other hand, setting the coil spring 37 immediately above the roller 32 as illustrated in FIG. 12C can reduce the effect of the spring pressure tolerance as compared with the configuration illustrated in FIG. 12A. In addition, the configuration illustrated in FIG. 12C can obtain the desired pressing force with a weaker spring pressure than the configuration illustrated in FIG. 12B. The configuration illustrated in FIG. 12C can also reduce the pressing force applied to the slider 34 because the pressing position on which the coil spring 37 presses the slider 34 can be set in the support position on which the guide rail 38 support the slider 34, and, even if the spring pressure is not so high, the desired pressing force can be obtained. Therefore, it is possible to avoid bending the slider 34.

As the teeth 41*a* of the blade 41 wear over time and lose sharpness, it is necessary to replace the blade 41 at a predetermined timing. Therefore, in the present embodiment, the teeth 41*a* are configured to be detachable so that the teeth 41*a* can be easily replaced.

Figure 13A:
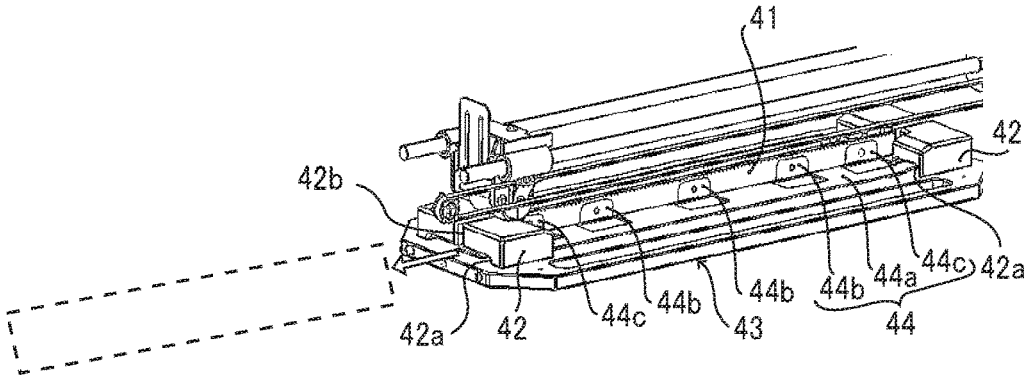
FIGS. 13A and 13B are perspective views illustrating attachment and detachment of the blade.
Figure 13B:
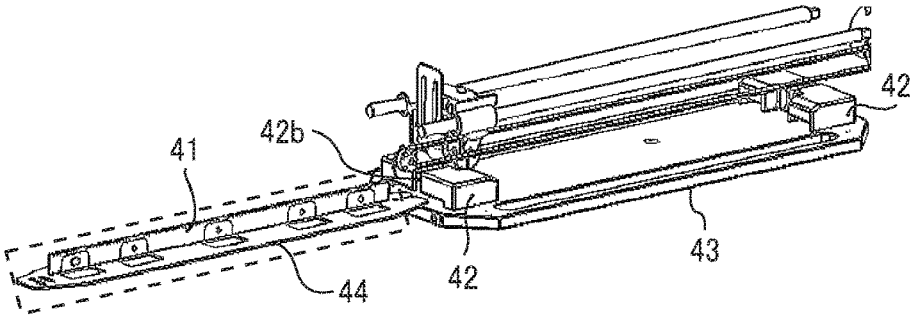

FIGS. 13A and 13B are perspective views illustrating attachment and detachment of the blade 41.

As illustrated in FIG. 13, the blade 41 is fixed to the blade fixing bracket 44 and can be pulled out together with the blade fixing bracket 44 in a direction of an arrow in FIG. 13A from a base 43 to be removed from the pressing mechanism 30.

The blade fixing bracket 44 is formed by sheet-metal working and includes a base surface 44*a* which is a surface perpendicular to the blade 41, mounting surfaces 44*b* to each of which the blade 41 is screwed, and positioning surfaces 44*c* where the blade is positioned. The positioning surfaces 44*c* and the mounting surfaces 44*b* are surfaces perpendicular to the base surface 44*a* and parallel to the blade. The positioning surfaces 44*c* are disposed at both ends in the sheet width direction that is a direction for attaching and detaching the blade. Three mounting surfaces 44*b* are disposed at predetermined intervals between the two positioning surfaces 44*c*.

A retraction base 42 disposed on the base 43 includes a cut-off port 42*a* that releases the base surface 44*a* of the blade fixing bracket 44 and an escape groove 42*b* that releases the blade 41. As illustrated in FIG. 13A, when the blade 41 is attached, both ends of the base surface 44*a* of the blade fixing bracket 44 in the sheet width direction that is the direction for attaching and detaching the blade enter the cut-off ports 42*a* to hold the blade fixing bracket 44 on the base 43.

Next, a description is provided of an attachment of the blade 41 to the blade fixing bracket 44.

Figure 14:
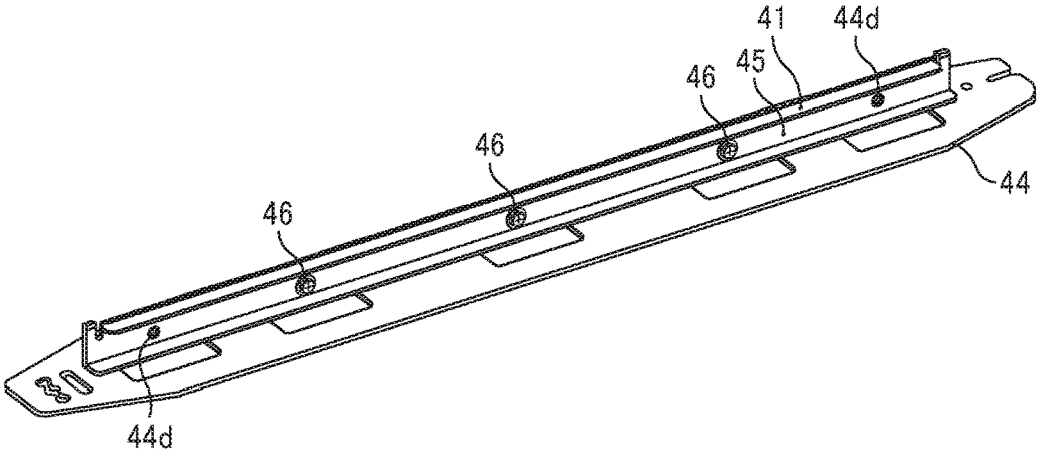
FIG. 14 is a perspective view illustrating the blade, a blade fixing bracket, and a blade retainer bracket.
Figure 15A:
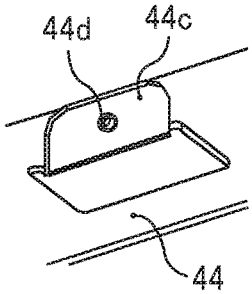
FIGS. 15A, 15B, and 15C are explanatory diagrams illustrating positioning of the blade on the blade fixing bracket.
Figure 15B:
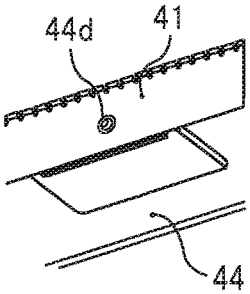
Figure 15C:
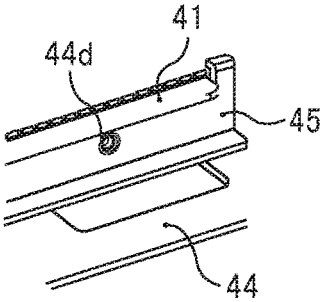

FIG. 14 is a perspective view illustrating the blade 41, the blade fixing bracket 44, and a blade retainer bracket 45. FIGS. 15A, 15B, and 15C are explanatory diagrams illustrating positioning of the blade 41 on the blade fixing bracket 44. FIGS. 16A to 16D are explanatory diagrams illustrating fixing the blade 41 on the blade fixing bracket 44.

As illustrated in FIG. 14, the blade 41 is attached so as to be sandwiched between the blade fixing bracket 44 and the blade retainer bracket 45.

As illustrated in FIG. 15A, the positioning surface 44*c* of the blade fixing bracket 44 has a positioning portion 44*d* protruded by a burring process. As illustrated in FIG. 15B, inserting the positioning portion 44*d* into a positioning hole formed in the blade 41 positions the blade 41 on the blade fixing bracket 44. As illustrated in FIG. 15C, inserting the positioning portion 44*d* into a positioning hole formed in the blade retainer bracket 45 positions the blade retainer bracket 45 on the blade fixing bracket 44.

Figure 16A:
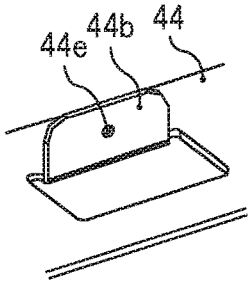
FIGS. 16A to 16D are explanatory diagrams illustrating fixing the blade on the blade fixing bracket.
Figure 16B:
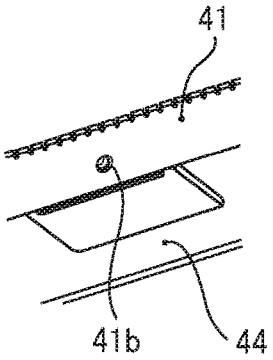
Figure 16C:
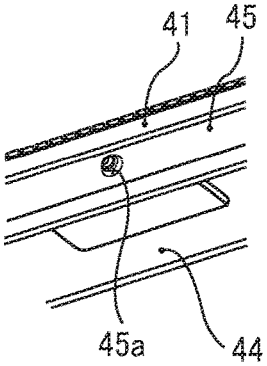
Figure 16D:
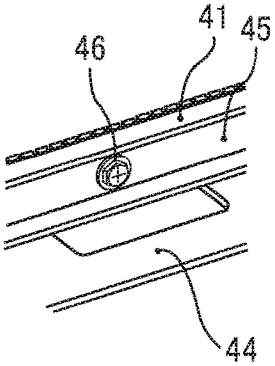

As illustrated in FIG. 16A, the mounting surface 44*b* of the blade fixing bracket 44 has a screw hole 44*e* having a thread groove formed on the inner peripheral surface of the screw hole 44*e*. When the blade 41 is positioned on the blade fixing bracket 44, as illustrated in FIG. 16B, a screw through-hole 41*b* provided in the blade 41 overlays the screw hole 44*e*. In addition, when the blade retainer bracket 45 is positioned, as illustrated in FIG. 16C, a screw through-hole 45*a* of the blade retainer bracket 45 overlays the screw hole 44*e*. Then, as illustrated in FIG. 16D, the screw 46 fixes the blade 41 to the blade fixing bracket 44.

Unlike the above-described configuration, a configuration in which the coil spring 37 presses the blade 41 separably contacting the pressing mechanism 30 toward the pressing mechanism 30 requires the base 43 separably contacting the pressing mechanism 30, which may increase an apparatus size. As another example different from the above-described configuration, the blade fixing bracket 44 separably contacting the pressing mechanism 30 is considered, but it is difficult to make such the blade fixing bracket 44 slidable in the sheet width direction, that is, it is difficult to make a configuration including such the blade fixing bracket 44 in which the blade 41 can be easily replaced.

On the other hand, in the present embodiment, a configuration in which the coil spring 37 presses the roller 32 separably contacting the blade 41 toward the blade 41 can avoid the increase in size of the apparatus. In addition, the blade fixing bracket 44 can be configured to be slidable in the sheet width direction merely by providing the cut-off ports 42*a* and the escape groove 42*b* in the base 43. This simple configuration allows the blade fixing bracket 44 slidable in the sheet width direction and easy replacement of the blade 41.

In the perforation forming operation described above, the pressing mechanism 30 positioned at the retracted position outside a sheet passing area moves from the retracted position at one end to the retracted position at the other end to form the stitch perforations in the sheet. However, in such the perforation forming operation, the roller 32 that moves from the retracted position rides over one end of the sheet in the width direction. When the roller 32 rides over one end of the sheet in the width direction, a force in the width direction is applied to the sheet, which may cause the skew of the sheet. Therefore, the leading end of the sheet is sandwiched by the ejection roller pair 12, the trailing end of the sheet is sandwiched by the entry roller pair 11, and the sheet is fixed by these roller pair to form the stitch perforations. However, when the pressing mechanism 30 forms the stitch perforations near the leading end or the trailing end of the sheet, since the sheet cannot be sandwiched by one of the entry roller pair 11 and the ejection roller pair 12, the skew of the sheet may occur.

To prevent occurrence of the skew described above, the roller 32 of the pressing mechanism 30 may be configured to be able to separate from the blade 41, move from a separated position at which the roller 32 is separated from the blade 41 to a pressing position that is a desired position opposite the sheet, and press the sheet to stick the sheet on the teeth 41*a* of the blade 41 and fix the sheet. Then, the pressing mechanism 30 may be configured to press the sheet and move along the sheet. This operation can form the stitch perforations in the sheet without the occurrence of the skew even when the entry roller pair 11 and the ejection roller pair 12 do not fix the sheet.

FIGS. 17A to 17E are explanatory diagrams illustrating an example of a separator 60 that separates the roller 32 of the pressing mechanism 30 from the pressing position.

As illustrated in FIGS. 17A to 17E, the separator 60 raises the guide rail 38 that supports the pressing mechanism 30 to move the roller 32 from the pressing position to the separated position in a direction away from the blade 41. The separator 60 is disposed at both ends of the guide rail 38 and includes a cam 61, a biasing member 63 to urge the guide rail 38 toward the cam 61, and a cam motor 62 to rotate the cam 61.

Figure 17A:
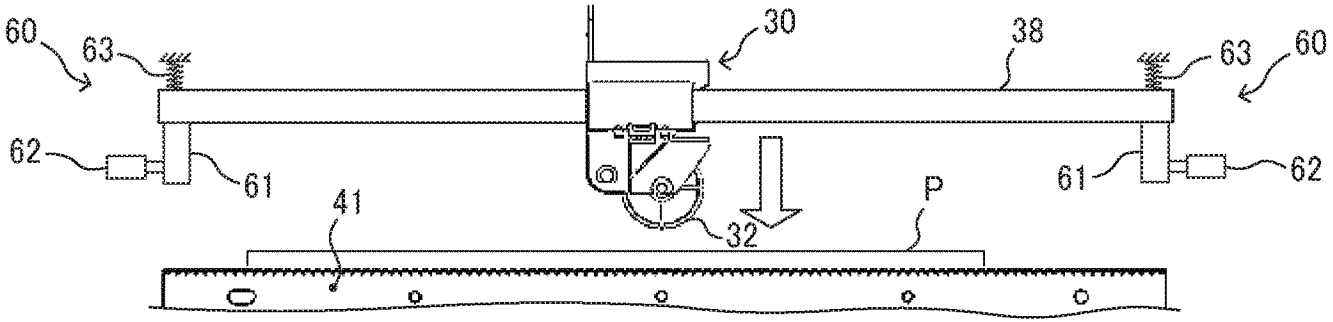
FIGS. 17A to 17E are explanatory diagrams illustrating an example of a separator that separates the roller of the pressing mechanism from a pressing position.

As illustrated in FIG. 17A, the pressing mechanism 30 on standby is positioned at the center of the sheet in the sheet width direction. In FIG. 17A, the upper fulcrum of the cam 61 contacts the guide rail 38 to position the roller 32 at the separated position. When the perforation forming position of the sheet P comes to a position opposed to the blade 41 and conveyance of the sheet is stopped, the cam 61 is rotated until the lower fulcrum of the cam 61 contacts the guide rail 38. Then, the pressing mechanism 30 approaches the blade 41, and the roller 32 contacts the sheet P. Subsequently, the pressing mechanism 30 descends to increase the pressing force of the roller 32 against the sheet. As a result, the teeth 41*a* pierces the sheet P, and when the roller 32 reaches the pressing position, the teeth 41*a* penetrates through the sheet P as illustrated in FIG. 17B, and the center of the sheet P in the sheet width direction is fixed by the blade 41.

Figure 17B:
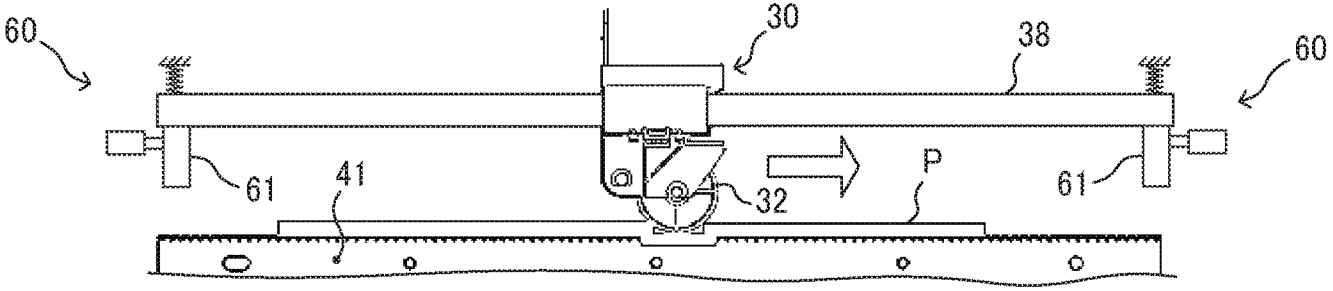
Figure 17C:
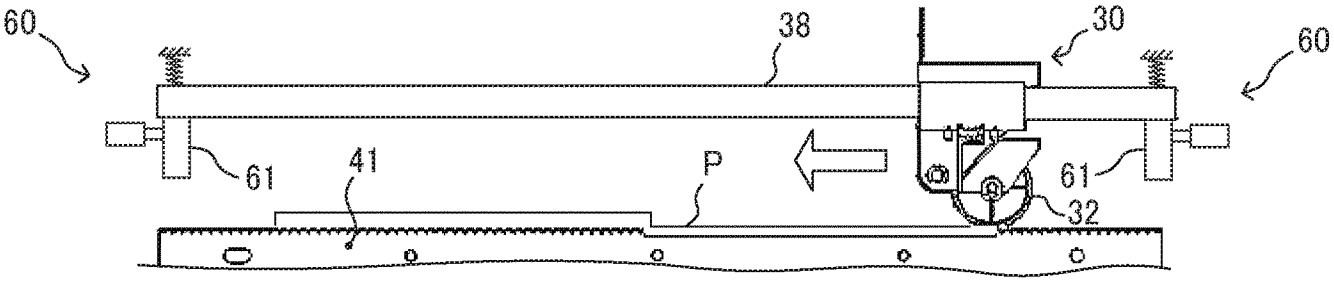

As described above, when the roller 32 moves to the pressing position, the driver 50 starts driving to move the pressing mechanism 30 to the right in FIG. 17B. When the roller 32 moves to the tight, the sheet receives a force in the sheet width direction due to a frictional force with the roller 32, but the sheet does not move in the sheet width direction because the center of the sheet is fixed by the teeth 41*a* that penetrates through the sheet. Therefore, the skew does not occur. When the roller 32 of the pressing mechanism 30 reaches the right end of the sheet in FIG. 17C, as illustrated in FIG. 17C, the driver 50 drives to reversely rotate the drive pulley 53 to move the pressing mechanism 30 to the left side in FIG. 17C.

Figure 17D:
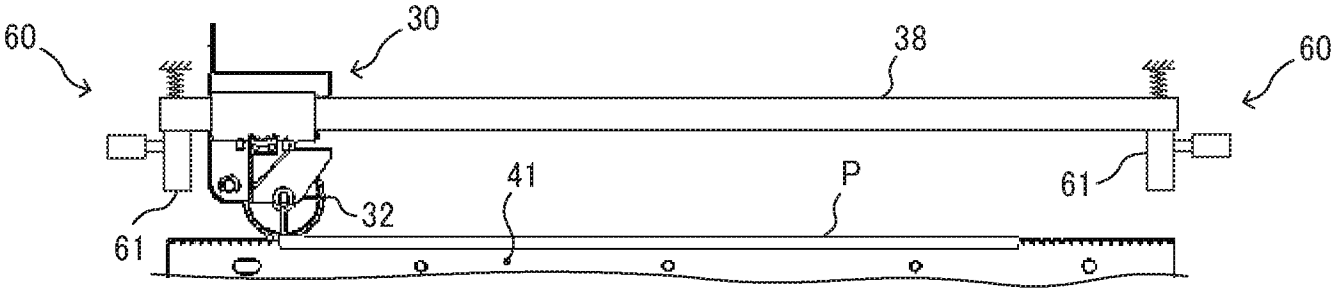
Figure 17E:
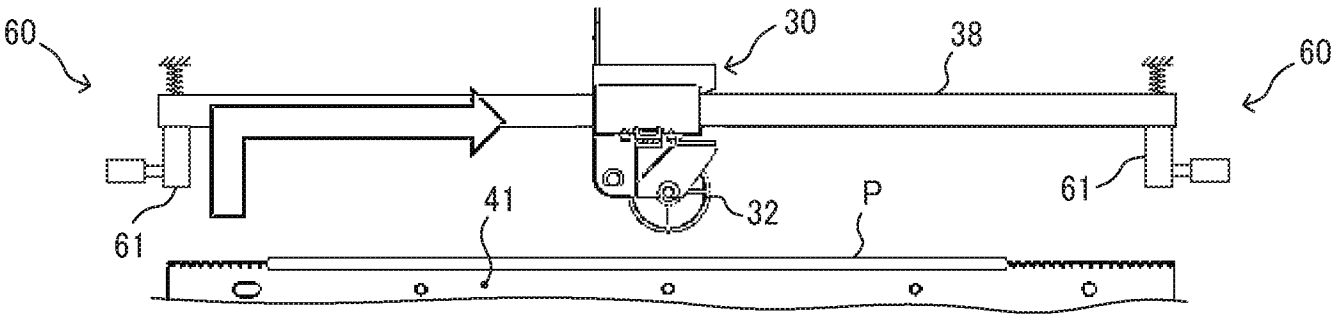

Next, as illustrated in FIG. 17D, when the pressing mechanism 30 moves to the left end of the sheet in FIG. 17D, the driver 50 stops a movement of the sheet and the cam 61 rotates to move the roller 32 from the pressing position to the separated position. When the roller 32 reaches the separated position, the driver 50 moves the pressing mechanism 30 to the right side in FIG. 17E to return the pressing mechanism to the center in the sheet width direction.

Since providing the separator 60 in this manner enables to move the pressing mechanism 30 after the teeth 41*a* penetrates through the sheet and fixes the sheet at the desired position in the sheet width direction, the skew does not occur even when the entry roller pair 11 and the ejection roller pair 12 do not sandwich the sheet. Therefore, the stitch perforations are satisfactorily formed.

Another example of the separator is described below.

FIGS. 18A to 18E are explanatory diagrams illustrating another example of the separator 70.

The separator 70 includes an actuator 71 attached to the pressing mechanism 30. A pressing member 71*a* of the actuator 71 pushes a pressing portion 33*e* disposed on the holder 33 and pivots the holder 33 counterclockwise in FIGS. 18A to 18E to separate the roller 32 supported by the holder 33 from the pressing position.

Figure 18A:
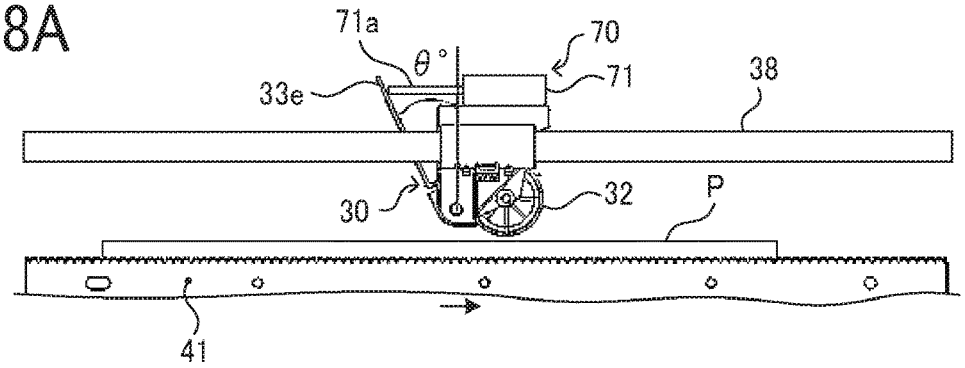
FIGS. 18A to 18E are explanatory diagrams illustrating another example of the separator.
Figure 18B:
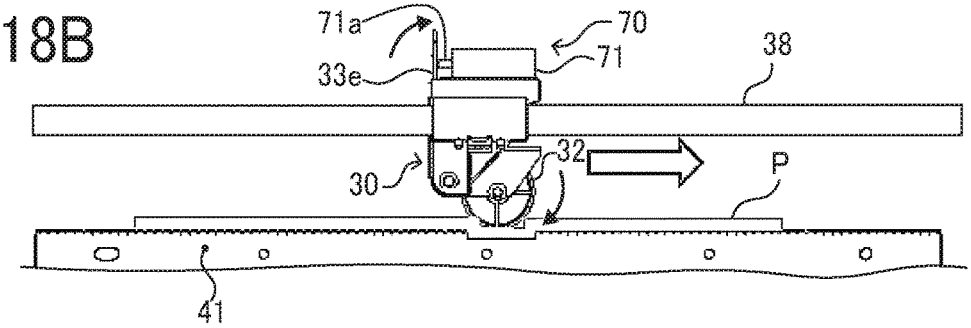

As illustrated in FIG. 18A, the pressing mechanism 30 on standby is positioned at the center of the sheet in the sheet width direction, and the pressing member 71*a* extends from the actuator 71 to push the pressing portion 33*e* to the left in FIG. 18A. Therefore, in FIG. 18A, the roller 32 is positioned at the separated position. When the sheet is conveyed to the perforator and stopped, as illustrated in FIG. 18B, the pressing member 71*a* is moved to the tight in FIG. 18B. Then, an urging force of the coil spring 37 pivots the holder 33 clockwise in FIG. 18B, the roller 32 moves from the separated position to the pressing position to push the sheet toward the blade. Then, the center of the sheet in the sheet width direction pierces the teeth 41*a* and the sheet is fixed to the blade 41.

Figure 18C:
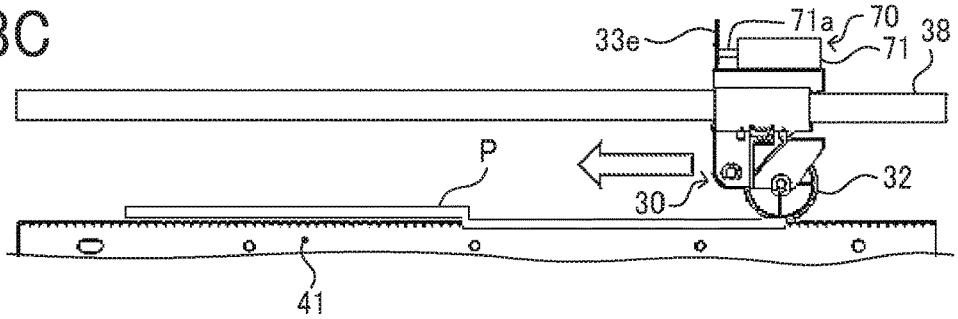
Figure 18D:
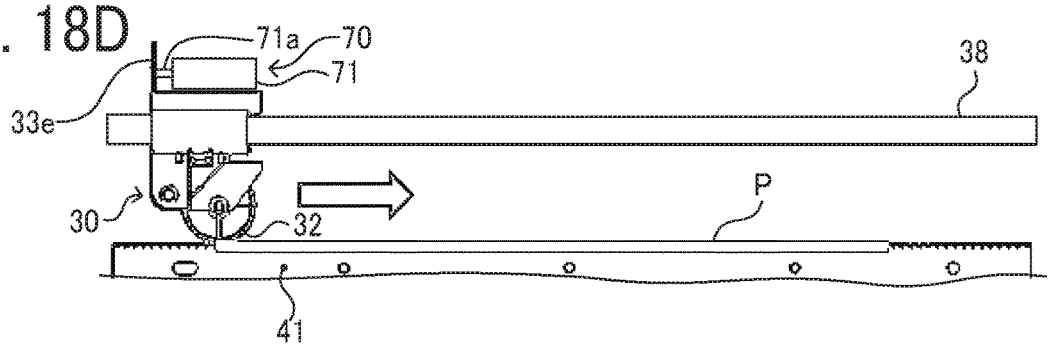
Figure 18E:
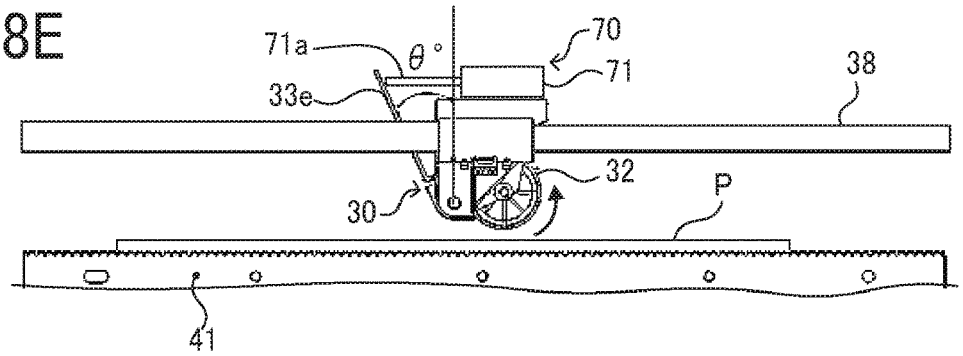

Next, as illustrated in FIG. 18C, after the pressing mechanism 30 moves to the right end of the sheet, the direction of movement is switched to the left, and the pressing mechanism 30 moves to the left end of the sheet to form the stitch perforations in the sheet as illustrated in FIG. 18D. After the stitch perforations are formed in the sheet, the actuator 71 is driven to move the pressing member 71*a* to the left in FIG. 18E and pivot the holder 33 counterclockwise in FIG. 18E. As a result, the roller 32 moves from the pressing position to the separated position. When the roller moves to the separated position, the pressing mechanism 30 is moved to the center of the sheet in the sheet width direction.

The embodiments described above are one example and provide advantages as below in a plurality of aspects 1 to 12.

First Aspect

The sheet processing apparatus according to the first aspect includes a blade such as the blade 41 having a plurality of teeth such as the teeth 41*a* aligned, a mover such as the roller 32 to move in a direction in which the plurality of teeth is aligned and form a perforation in a sheet sandwiched by the blade and the mover, and a pressure device such as the coil spring 37 to press the mover toward the blade.

In the first aspect, the pressure device to press the mover moving in the direction in which the plurality of teeth is aligned toward the blade does not cause variation of the pressing force, which occurs when the pressure devices presses the blade toward the mover because a plurality of pressure devices are needed, in the direction in which the plurality of teeth is aligned.

Since the pressure device can press the sheet against the blade with the same force in the direction in which the plurality of teeth is aligned, the amount of penetration of the teeth into the sheet is uniform. As a result, a uniform perforation can be formed on the sheet.

Second Aspect

In the second aspect, the mover such as the roller 32 of the sheet processing apparatus according to the first aspect has a groove such as the groove 32*a* at a position opposite the blade.

According to the second aspect, as described in the embodiment, when the roller contacts the sheet, a gap is generated between the groove of the roller and the sheet. This allows reliably protruding the teeth from the sheet and enables forming good stitch perforations.

Third Aspect

In the third aspect, the mover such as the roller 32 of the sheet processing apparatus according to the first aspect is a roller configured to rotate and move in the direction in which the plurality of teeth is aligned.

According to the third aspect, as described in the embodiment, it is possible to reduce the moving resistance of the mover.

Fourth Aspect

In the fourth aspect, the sheet processing apparatus according to the first aspect includes a holder such as the holder 33 to hold the mover so as to be pivotable in a direction perpendicular to the sheet, and a distance between the blade and a pivoting fulcrum such as the support shaft 33*b* in the present embodiment of the mover is equal to or larger than a distance between the blade and a supporting position such as the shaft 32*b* in the present embodiment at which the holder holds the mover.

According to the fourth aspect, as described with reference to FIGS. 9A and 9B, compared with a case when the distance between the blade and the pivoting fulcrum such as the support shaft 33*b* of the mover such as the roller 32 is less than the distance between the blade and the supporting position such as the shaft 32*b* at which the holder 33 holds the mover, a jump of the mover while the mover moves is prevented, which prevents the pressing force from decreasing. As a result, the stitch perforations can be formed satisfactorily.

Fifth Aspect

In the fifth aspect, the pivoting fulcrum such as the support shaft 33*b* of the mover such as the roller 32 of the sheet processing apparatus according to the fourth aspect is configured to be on an upstream side from the mover in a direction of movement of the mover when the mover moves to form the perforation.

According to the fifth aspect, as described with reference to FIGS. 10A and 10B, compared with a case when the pivoting fulcrum such as the support shaft 33*b* of the mover is configured to be on a downstream side from the mover in the direction of movement of the mover when the mover moves to form the perforation, the pressing force that presses the sheet toward the blade can be increased. As a result, the stitch perforations can be formed satisfactorily.

Sixth Aspect

In the sixth aspect, the sheet processing apparatus according to the first aspect includes a controller such as the controller 56 to control the mover, and the controller determines a direction of movement of the mover such as the roller 32 when the mover moves to form the perforation based on data of the sheet.

According to the sixth aspect, as described in the embodiment, when a sheet such as a thin sheet in which the stitch perforations can be satisfactorily formed even with a weak pressing force is used, the direction of movement of the mover to form the stitch perforations is not limited. This enables to form the stitch perforations by moving the mover from one side to the other side in the sheet width direction and the stitch perforations for the next sheet by moving the mover from the other side to the one side. This improves productivity compared to a case where the direction of movement of the mover when the perforations are formed is limited to the direction of movement in which the pivoting fulcrum is on the upstream side from the mover in a direction of movement of the mover when the mover moves to form the perforations.

On the other hand, when a sheet such as a thick sheet in which a strong pressing force is needed to form the stitch perforations is used, the direction of movement of the mover to form the stitch perforations is limited to the direction of movement in which the pivoting fulcrum of the mover is on the upstream side from the mover in a direction of movement of the mover. As a result, the stitch perforations for the thick sheet can be formed satisfactorily.

Seventh Aspect

In the seventh aspect, the pressure device such as the coil spring 37 of the sheet processing apparatus according to the fourth aspect presses a portion of the holder such as the holder 33, and the portion is opposite the mover such as the roller 32.

According to the seventh aspect, as described with reference to FIGS. 12A to 12C, it is possible to prevent the slider 34 holding the holder 33 from bending.

Eighth Aspect

In the eighth aspect, the sheet processing apparatus according to the first aspect includes a controller to control the mover, and the controller determines a number of times of movement of the mover when the mover moves to form the perforation based on data of the sheet.

The sheet processing apparatus according to the eighth aspect, as described in the embodiment, can satisfactorily form the stitch perforations on the sheet that is easy to form the stitch perforations such as thin paper with a small number of times of movement of the mover, which is once in the present embodiment, and improve productivity. On the other hand, when the stitch perforations are formed on the sheet which is difficult to form the stitch perforations such as thick paper, the sheet processing apparatus can increase the number of times of movement of the mover, so that it is possible to form perforations satisfactorily.

Ninth Aspect

In the ninth aspect, the blade of the sheet processing apparatus according to the first aspect is detachably attached to the sheet processing apparatus.

According to the ninth aspect, it is possible to easily replace the blade. In addition, as described in the first aspect, the configuration in which the pressure device such as the coil spring 37 presses the mover toward the blade enables to fix the blade to the sheet processing apparatus body, which easily attain a detachable configuration of the blade.

Tenth Aspect

In the tenth aspect, the sheet processing apparatus according to the first aspect includes a separator such as the separator 60 to separate the mover such as the roller 32 from the teeth of the blade, and the mover moves in the direction in which the plurality of teeth is aligned to form the perforation in the sheet after the separator moves the mover opposite the sheet from a separated position at which the separator separates the mover from the teeth of the blade to a pressing position at which the mover presses the sheet toward the blade.

According to the tenth aspect, as described with reference to FIG. 17 and FIG. 18, the movement of the mover opposite the sheet from the separated position at which the separator separates the mover from the teeth of the blade to the pressing position at which the mover presses the sheet toward the blade pierces the teeth of the blade into the sheet, allowing the sheet to be secured to the blade. Therefore, after the movement of the mover, the movement of the mover positioned in the pressing position in the direction in which the plurality of teeth is aligned does not cause skew in the sheet and enables formation of the good stitch perforations. In addition, when the mover moves in the direction in which the plurality of teeth is aligned to form the stitch perforations, it is not necessary for the entry roller pair and the ejection roller pair to pinch the sheet so that the sheet does not move in the direction in which the plurality of teeth is aligned. As a result, it is possible to form the stitch perforations satisfactorily in the vicinity of the leading edge of the sheet or in the vicinity of the rear end of the sheet.

Eleventh Aspect

In the eleventh aspect, an image forming apparatus includes an image forming device to form an image on a sheet and the sheet processing apparatus according to the first aspect.

According to this, the stitch perforations can be formed on the sheet satisfactorily.

Twelfth Aspect

In the twelfth aspect, an image forming system such as the image forming system 4 includes an image forming apparatus such as the image forming apparatus 3 to form an image on a sheet and the sheet processing apparatus such as the stitch perforation forming apparatus 1 according to the first aspect to process the sheet.

According to this, the stitch perforations can be formed on the sheet satisfactorily.

It is to be noted that the above embodiment is presented as examples to realize the present disclosure, and it is not intended to limit the scope of the disclosure. These novel embodiments can be implemented in various other forms, and various omissions, substitutions, and changes can be made without departing from the gist of the disclosure. These embodiments and variations are included in the scope and gist of the disclosure and are included in the disclosure described in the claims and the equivalent scope thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a blade having a plurality of teeth aligned in a row;

a mover to move along a direction in which the plurality of teeth are aligned and form a perforation in a sheet sandwiched between the blade and the mover, the mover including a groove at a position opposite the blade; and a pressure device to press the mover toward the blade.

2. The sheet processing apparatus of claim 1, wherein the mover is a roller to rotate and move in the direction along which the plurality of teeth are aligned.

3. The sheet processing apparatus of claim 1, further comprising a controller to control the mover, the controller being configured to determine, based on data of the sheet, at least one of a number of times of movement of the mover when the mover moves to form the perforation, and a direction of movement of the mover when the mover moves to form the perforation.

4. The sheet processing apparatus of claim 1, wherein the blade is detachably attached in the sheet processing apparatus.

5. The sheet processing apparatus of claim 1, further comprising:

a separator to separate the mover from the teeth of the blade, wherein the mover is configured to move along the direction in which the plurality of teeth are aligned to form the perforation in the sheet after the separator moves the mover opposite the sheet from a separated position at which the separator is configured to separate the mover from the teeth of the blade to a pressing position at which the mover is configured to press the sheet toward the blade.

6. An image forming apparatus, comprising:

an image forming device to form an image on a sheet; and the sheet processing apparatus to process the sheet of claim 1.

7. An image forming system, comprising:

an image forming apparatus to form an image on a sheet, and the sheet processing apparatus to process the sheet of claim 1.

8. A sheet processing apparatus, comprising:

a blade having a plurality of teeth aligned in a row;

a mover to move along a direction in which the plurality of teeth are aligned and form a perforation in a sheet sandwiched between the blade and the mover;

a pressure device to press the mover toward the blade; and a holder to hold the mover so that the mover is pivotable in a direction perpendicular to the sheet, wherein a distance between the blade and a pivoting fulcrum of the mover is equal to or larger than a distance between the blade and a supporting position at which the holder holds the mover.

9. The sheet processing apparatus of claim 8, wherein the pivoting fulcrum of the mover is configured to be on an upstream side from the mover in a direction of movement of the mover when the mover moves to form the perforation.

10. The sheet processing apparatus according of claim 8, wherein the pressure device is configured to press a portion of the holder opposite the mover.

11. An image forming apparatus, comprising:

an image forming device to form an image on a sheet; and the sheet processing apparatus to process the sheet of claim 8.

12. An image forming system, comprising:

an image forming apparatus to form an image on a sheet, and the sheet processing apparatus to process the sheet of claim 8.

13. The sheet processing apparatus of claim 8, wherein the mover has a groove at a position opposite the blade.

14. The sheet processing apparatus of claim 8, wherein the mover is a roller to rotate and move in the direction along which the plurality of teeth are aligned.

15. A sheet processing apparatus, comprising:

a blade having a plurality of teeth aligned in a row;

a mover to move along a direction in which the plurality of teeth are aligned and form a perforation in a sheet sandwiched between the blade and the mover;

a pressure device to press the mover toward the blade; and a controller to control the mover, the controller being configured to determine, based on data of the sheet, at least one of a direction of movement of the mover when the mover moves to form the perforation, and a number of times of movement of the mover when the mover moves to form the perforation.

16. An image forming apparatus, comprising:

an image forming device to form an image on a sheet; and the sheet processing apparatus to process the sheet of claim 15.

17. An image forming system, comprising:

an image forming apparatus to form an image on a sheet, and the sheet processing apparatus to process the sheet of claim 15.

18. The sheet processing apparatus according to claim 15, wherein the mover has a groove at a position opposite the blade.

19. The sheet processing apparatus of claim 15, wherein the mover is a roller to rotate and move in the direction along which the plurality of teeth are aligned.

* * * * *